United States Patent [19]

Hoots et al.

[11] Patent Number: 4,904,413

[45] Date of Patent: Feb. 27, 1990

[54] COOLING WATER CORROSION CONTROL METHOD AND COMPOSITION

[75] Inventors: John E. Hoots; Donald A. Johnson, both of Naperville, Ill.

[73] Assignee: Nalco Chemical Company, Naperville, Ill.

[21] Appl. No.: 287,633

[22] Filed: Dec. 20, 1988

Related U.S. Application Data

[63] Continuation of Ser. No. 122,528, Nov. 18, 1987, abandoned, which is a continuation of Ser. No. 844,415, Mar. 26, 1986, abandoned.

[51] Int. Cl.[4] ..... C23F 11/06; C23F 11/16; C02F 5/10

[52] U.S. Cl. ..... 252/389.23; 252/389.22; 252/180; 422/13; 422/15

[58] Field of Search ..... 252/389.23, 389.22, 252/180; 422/13, 15

[56] References Cited

U.S. PATENT DOCUMENTS

| | | | |
|---|---|---|---|
| 3,630,938 | 12/1971 | Troscinski . | |
| 3,880,765 | 4/1975 | Watson . | |
| 3,886,204 | 5/1975 | Geffers et al. . | |
| 3,891,568 | 6/1975 | Nishio et al. | 252/389.22 X |
| 3,959,168 | 5/1976 | Germscheid et al. . | |
| 3,992,318 | 11/1976 | Gaupp et al. | 252/181 X |
| 4,026,815 | 5/1977 | Kallfass et al. | 252/389.23 X |
| 4,033,896 | 7/1977 | Mitchell et al. | 252/389.22 |
| 4,052,160 | 10/1977 | Cook et al. | 422/15 |
| 4,159,922 | 7/1979 | Cosper . | |
| 4,163,733 | 8/1979 | Buckman et al. | 252/389.22 X |
| 4,209,398 | 6/1980 | Ii et al. | 252/180 X |
| 4,243,524 | 1/1981 | Fenyes et al. | 252/389.22 X |
| 4,246,030 | 1/1981 | Lipinski | 252/389.22 X |
| 4,303,568 | 12/1981 | May et al. . | |
| 4,317,744 | 3/1982 | Levi | 252/389.22 |
| 4,401,587 | 8/1983 | Boffardi | 252/389.22 |
| 4,406,811 | 9/1983 | Christensen et al. | 252/180 |
| 4,432,879 | 2/1984 | Greaves et al. | 252/180 X |
| 4,432,884 | 2/1984 | Kawasaki et al. . | |
| 4,443,340 | 4/1984 | May et al. . | |
| 4,532,048 | 7/1985 | Amjad et al. . | |
| 4,547,540 | 10/1985 | Yeoman . | |
| 4,566,973 | 1/1986 | Masler, III et al. . | |
| 4,600,524 | 7/1986 | Cuisia et al. | 252/180 X |
| 4,680,124 | 7/1987 | Young et al. | 252/181 X |
| 4,705,703 | 11/1987 | Meier et al. | 252/389.52 X |
| 4,744,949 | 5/1988 | Hoots et al. | 422/15 |
| 4,752,443 | 6/1988 | Hoots et al. | 422/13 |
| 4,756,881 | 7/1988 | Hoots et al. | 422/13 |

FOREIGN PATENT DOCUMENTS

| | | | |
|---|---|---|---|
| 1117395 | 2/1982 | Canada | 252/180 |
| 267597 | 5/1988 | European Pat. Off. | 252/180 |
| 2749719 | 5/1978 | Fed. Rep. of Germany | 252/180 |

OTHER PUBLICATIONS

D. T. Reed and R. Nass, Minutes of the 36th Annual Meeting of International Water Conference, "Small-Scale Short-Term Methods of Evaluating Cooling Water Treatments . . . Are They Worthwhile?", Pittsburgh, Pa., Nov. 4–6, 1975.

*Primary Examiner*—Matthew A. Thexton

*Attorney, Agent, or Firm*—John G. Premo; Anthony L. Cupoli; Donald G. Epple

[57] ABSTRACT

A composition and method for inhibiting corrosion in industrial cooling waters which contain hardness and have a pH of at least 8, which composition comprises a water-soluble organic phosphonate capable of inhibiting corrosion in an aqueous alkaline environment and a co- or terpolymer of acrylic acid and certain substituted acrylamides such as t-butyl acrylamide.

3 Claims, No Drawings

COOLING WATER CORROSION CONTROL METHOD AND COMPOSITION

This is a continuation of co-pending application Ser. No. 122,528, filed on Nov. 18, 1987, which is a continuation of application Ser. No. 844,415, filed on Mar. 26, 1986, both now abandoned.

FIELD OF INVENTION

A composition and method for inhibiting corrosion in industrial cooling waters which contain hardness and have a pH of at least 8, which composition comprises a water-soluble organic phosphonate capable of inhibiting corrosion in an aqueous alkaline environment and a co- or terpolymer of acrylic acid and certain substituted acrylamides such as t-butyl acrylamide.

The term "phosphonate" refers to organic materials containing one or more $—PO_3H_2$ groups and salts thereof. Phosphonates particularly useful in this invention include 1-hydroxy-1,1-ethane diphosphonic acid (HEDP), 2-phosphonobutane-1,2,4-tricarboxylic acid (PBTC), amino-tris-methylenephosphonic acid (AMP), and their salts. The concentrations and dosage levels and/or ranges of polymers, phosphonates and compositions are listed as actives.

INTRODUCTION

Corrosion occurs when metals are oxidized to their respective ions and/or insoluble salts. For example, corrosion of metallic iron can involve conversion to soluble iron in a +2 or +3 oxidation state or insoluble iron oxides and hydroxides. Also, corrosion has a dual nature in that a portion of the metal surface is removed, while the formation of insoluble salts contributes to the buildup of deposits. Losses of metal cause deterioration of the structural integrity of the system. Eventually leakage between the water system and process streams can occur.

Corrosion of iron in oxygenated waters is known to occur by the following coupled electrochemical processes:

$$Fe^{o} \rightarrow Fe^{+2} + 2e^{-} \text{(Anodic Reaction)} \quad (1)$$

$$O_2 + 2e^{-} \rightarrow 2OH^{-} \text{(Cathodic Reaction)} \quad (2)$$

Inhibition of metal corrosion by oxygenated waters typically involves the formation of protective barriers on the metal surface. These barriers prevent oxygen from reaching the metal surface and causing metal oxidation. In order to function as a corrosion inhibitor, a chemical additive must facilitate this process such that an oxygen-impermeable barrier is formed and maintained. This can be done by interaction with either the cathodic or anodic half-cell reaction.

Inhibitors can interact with the anodic reaction 1 by causing the resultant $Fe^{+2}$ to form an impermeable barrier, stifling further corrosion. This can be accomplished by including ingredients in the inhibitor compound which: react directly with $Fe^{+2}$ causing it to precipitate; facilitate the oxidation of $Fe^{+2}$ to $Fe^{+3}$, compounds of which are typically less soluble; or promote the formation of insoluble $Fe^{+3}$ compounds.

The reduction of oxygen at corrosion cathodes provides another means by which inhibitors can act. Reaction 2 represents the half-cell in which oxygen is reduced during the corrosion process. The product of this reaction is the hydroxyl ($OH^-$) ion. Because of hydroxyl production, the pH at the surface of metals undergoing oxygen-mediated corrosion is generally much higher than that of the surrounding medium. Many compounds are less soluble at elevated pH's. These compounds can precipitate at corrosion cathodes and act as effective inhibitors of corrosion if their precipitated form is impervious to oxygen and is electrically nonconductive.

Corrosion inhibitors function by creating an environment in which the corrosion process induces inhibitive reactions on the metal surface. In order for an inhibitor composition to function effectively, the components of the composition must not precipitate under the conditions in the bulk medium. Inhibitors which effectively inhibit this precipitation by kinetic inhibition have been extensively described in the literature. An example of this art is U.S. Pat. No. 3,880,765 which teaches the use of polymers for prevention of calcium carbonate precipitation.

The use of inorganic phosphates and phosphonates in conjunction with a threshold inhibitor in order to control corrosion by oxygenated waters is described by U.S. Pat. No. 4,303,568. This method is further elaborated by U.S. Pat. No. 4,443,340 which teaches that a composition comprised of only inorganic phosphates and a polymeric inhibitor performs well in the presence of dissolved iron.

Corrosion inhibition can be achieved by a combination of the use of inhibitors and modification of the chemistry of the medium. U.S. Pat. No. 4,547,540 teaches a method of corrosion inhibition relying on operation under conditions of high pH and alkalinity. This method does not rely on the use of inorganic phosphates, giving a more desirable product from an environmental impact point of view.

The current invention describes phosphonate corrosion inhibiting compounds, containing a unique series of polymers, phosphonates and the optional use of aromatic azoles. The use of these polymers results in significantly improved corrosion inhibitor performance.

The use of the copolymers of this invention as scale inhibitors is discussed in U.S. Pat. No. 4,566,973. In general, these compounds are copolymers containing t-butyl acrylamide units in conjunction with other comonomers. We have found that these compounds are effective calcium phosphonate inhibitors and that they function effectively as components in a phosphonate containing corrosion inhibitor compound.

INVENTION

A composition for inhibiting corrosion in industrial cooling waters which contain hardness and have a pH of at least 8 which composition comprises:

I. A water-soluble organic phosphonate, which term includes blends of phosphonates, capable of providing corrosion inhibition in an aqueous alkaline environment, and II. A water-soluble non-crosslinked random polymer of 50 to 90 weight parts of an acrylic acid and 10 to 50 weight parts of a substituted acrylamide, on the basis of a total of 100 weight parts of polymerized monomers, said copolymer having weight average molecular weight in the range of about 1,000 to 50,000 and the polymerized units of an acrylic acid and a substituted acrylamide are defined by the following formula:

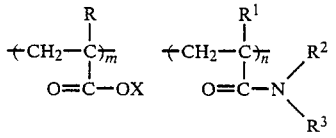

where m is the range of about 10–700 and n is in the range of about 0.1 to 350, subject to the molecular weight limitations, R and $R^1$ are individually selected from hydrogen and methyl;

X is selected from hydrogen, sodium, potassium, calcium, ammonium, and magnesium moieties;

and $R^2$ and $R^3$ are individually selected from hydrogen, and substituted and unsubstituted groups each containing a total of 1 to 8 carbon atoms, wherein the substituents on $R^2$ and/or $R^3$ are selected from alkyl, aryl, and keto groups, provided that $R^2$ and/or $R^3$ is other than hydrogen with the weight ratio of II to I being 0.2/1 to 2/1 and preferably 0.75/1.

The Phosphonates

Generally any water-soluble phosphonate may be used that is capable of providing corrosion inhibition in alkaline systems. See U.S. Pat. No. 4,303,568 which lists a number of representative phosphonates. The disclosure is incorporated herein by reference.

The Organo-Phosphonic Acid Derivatives

The organo-phosphonic acid compounds are those having a carbon to phosphorus bond, i.e.,

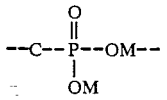

Compounds within the scope of the above description generally are included in one of perhaps 3 categories which are respectively expressed by the following general formulas:

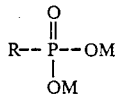

where R is lower alkyl having from about one to six carbon atoms, e.g., methyl, ethyl, butyl, propyl, isopropyl, pentyl, isopentyl and hexyl; substituted lower alkyl of from one to six carbon atoms, e.g., hydroxyl and amino-substituted alkyls; a mononuclear aromatic (aryl) radical, e.g., phenyl, benzene, etc., as a substituted mononuclear aromatic compound, e.g., hydroxyl, amino, lower alkyl substituted aromatic, e.g., benzyl phosphonic acid; and M is a water-soluble cation, e.g., sodium, potassium, ammonium, lithium, etc. or hydrogen.

Specific examples of compounds which are encompassed by this formula include:

methylphosphonic acid
$CH_3PO_3H_2$ ethylphosphonic acid

-continued $CH_3CH_2PO_3H_2$ 2-hydroxyethylphosphonic acid
$CH_2—CH_2—PO_3H_2$
|
OH 2-amino-ethylphosphonic acid
$CH_2—CH_2—PO_3H_2$
|
$NH_2$ isopropylphosphonic acid
$CH_3—CH(CH_3)—CH_2—PO_3H_2$ benzene phosphonic acid
$C_6H_5—PO_3H_2$ benzylphosphonic acid
$C_6H_5CH_2PO_3H_2$

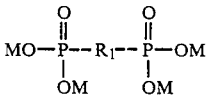

wherein $R_1$ is an alkylene having from about one to about 12 carbon atoms or a substituted alkylene having from about 1 to about 12 carbon atoms, e.g., hydroxyl, amino etc. substituted alkylenes, and M is as earlier defined above.

Specific exemplary compounds and their respective formulas which are encompassed by the above formula are as follows:

methylene diphosphonic acid
$H_2O_3P—CH_2—PO_3H_2$ ethylidene diphosphonic acid
$H_2O_3P—CH(CH_3)PO_3H_2$ isopropylidene diphosphonic acid
$(CH_3)_2C(PO_3H_2)_2$ 1-hydroxy, ethylidene diphosphonic acid (HEDP)
$H_2O_3P—C(OH)(CH_3)—PO_3H_2$ hexamethylene diphosphonic acid
$H_2O_3P—CH_2(CH_2)_4CH_2—PO_3H_2$ trimethylene diphosphonic acid
$H_2O_3P—(CH_2)_3—PO_3H_2$ decamethylene diphosphonic acid
$H_2O_3P—(CH_2)_{10}—PO_3H_2$ 1-hydroxy, propylidene diphosphonic acid
$H_2O_3PC(OH)CH_2(CH_3)PO_3H_2$ 1,6-dihydroxy, 1,6-dimethyl, hexamethylene diphosphonic acid
$H_2O_3PC(CH_3)(OH)(CH_2)_4C(CH_3)(OH)PO_3H_2$ dihydroxy, diethyl ethylene diphosphonic acid
$H_2O_3PC(OH)(C_2H_5)C(OH)(C_2H_5)PO_3H_2$

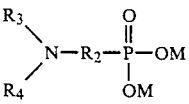

where $R_2$ is a lower alkylene having from about one to about four carbon atoms, or an amine or hydroxy substituted lower alkylene; $R_3$ is $[R_2—PO_3M_2]$ H, OH, amino, substituted amino, an alkyl having from one to six carbon atoms, a substituted alkyl of from one to six carbon atoms (e.g., OH, $NH_2$ substituted) a mononuclear aromatic radical and a substituted mononuclear aromatic radical (e.g., OH, $NH_2$ substituted); $R_4$ is $R_3$ or the group represented by the formula

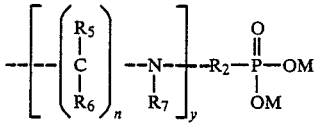

where $R_5$ and $R_6$ are each hydrogen, lower alkyl of from about one to six carbon atoms, a substituted lower alkyl (e.g., OH, $NH_2$ substituted), hydrogen, hydroxyl, amino group, substituted amino group, a mononuclear aromatic radical, and a substituted mononuclear aromatic radical (e.g., OH and amine substituted); R is $R_5$, $R_6$, or the group $R_2$—$PO_3M_2$ ($R_2$ is as defined above); n is a number of from 1 through about 15; y is a number of from about 1 through about 14; and M is as earlier defined.

Compounds or formulas therefore which can be considered exemplary for the above formulas are as follows:

nitrilo-tri(methylene phosphonic acid)
$N(CH_2PO_3H_2)_3$
imino-di(methylene phosphonic acid)
$NH(CH_2PO_3H_2)_2$
n-butyl-amino-di(methyl phosphonic acid)
$C_4H_9N(CH_2PO_3H_2)_2$
decyl-amino-di(methyl phosphonic acid)
$C_{10}H_{21}N(CH_2PO_3H_2)_2$
trisodium-pentadecyl-amino-di-methyl phosphate
$C_{15}H_{31}N(CH_2PO_3HNa)(CH_2PO_3Na_2)$
n-butyl-amino-di(ethyl phosphonic acid)
$C_4H_9N(CH_2CH_2PO_3H_2)_2$
tetrasodium-n-butyl-amino-di(methyl phosphate)
$C_4H_9N(CH_2PO_3Na_2)_2$
triammonium tetradecyl-amino-di(methyl phosphate)
$C_{14}H_{29}N(CH_2PO_3(NH_4)_2)CH_2PO_3HNH_4$
phenyl-amino-di(methyl phosphonic acid)
$C_6H_5N(CH_2PO_3H_2)_2$
4-hydroxy-phenyl-amino-di(methyl phosphonic acid)
$HOC_6H_4N(CH_2PO_3H_2)_2$
phenyl propyl amino-di(methyl phosphonic acid)
$C_6H_5(CH_2)_3N(CH_2PO_3H_2)_2$
tetrasodium phenyl ethyl amino-di(methyl phosphonic acid)
$C_6H_5(CH_2)_2N(CH_2PO_3Na_2)_2$
ethylene diamine tetra(methyl phosphonic acid)
$(H_2O_3PCH_2)_2N(CH_2)_2N(CH_2PO_3H_2)_2$
trimethylene diamine tetra(methyl phosphonic acid)
$(H_2O_3PCH_2)_2N(CH_2)_3N(CH_2PO_3H_2)_2$
hepta methylene diamine tetra(methyl phosphonic acid)
$(H_2O_3PCH_2)_2N(CH_2)_7N(CH_2PO_3H_2)_2$
decamethylene diamine tetra(methyl phosphonic acid)
$(H_2O_3PCH_2)_2N(CH_2)_{10}N(CH_2PO_3H_2)_2$
tetradecamethylene diamine tetra(methyl phosphonic acid)
$(H_2O_3PCH_2)_2N(CH_2)_{14}N(CH_2PO_3H_2)_2$
ethylene diamine tri(methyl phosphonic acid)
$(H_2O_3PCH_2)_2N(CH_2)_2NHCH_2PO_3H_2$
ethylene diamine di(methyl phosphonic acid)
$H_2O_3PCH_2)_2NH(CH_2)_2NHCH_2PO_3H_2$
n-hexyl amine di(methyl phosphonic acid)
$C_6H_{13}N(CH_2PO_3H_2)_2$
diethylamine triamine penta(methyl phosphonic acid)
$(H_2O_3PCH_2)_2N(CH_2)_2N(CH_2PO_3H_2)$-
$(CH_2)_2N(CH_2PO_3H_2)_2$
ethanol amine di(methyl phosphonic acid)
$HO(CH_2)_2N(CH_2PO_3H_2)_2$
n-hexyl-amino(isopropylidene phosphonic acid)methylphosphonic acid
$C_6H_{13}N(C(CH_3)_2PO_3H_2)(CH_2PO_3H_2)$
trihydroxy methyl, methyl amine di(methyl phosphonic acid -continued $(HOCH_2)_3CN(CH_2PO_3H_2)_2$
triethylene tetra amine hexa(methyl phosphonic acid)
$(H_2O_3PCH_2)_2N(CH_2)_2N(CH_2PO_3H_2)(CH_2)_2N$—
$(CH_2PO_3H_2)(CH_2)_2N(CH_2PO_3H_2)_2$
monoethanol, diethylene triamine tri(methyl phosphonic acid
$HOCH_2CH_2N(CH_2PO_3H_2)(CH_2)_2NH(CH_2)_2N$—
$(CH_2PO_3H_2)_2$
chloroethylene amine di(methyl phosphonic acid)
$ClCH_2CH_2N((CH_2PO(OH)_2)_2$ The above compounds are included for illustration purposes and are not intended to be a complete listing of the compounds which are operable within the confines of the invention.

Preferred phosphonates are the two compounds:

A. 2-phosphonobutane-1,2,4-tricarboxylic acid and

B. 1-hydroxyethane-1,1-diphosphonic acid.

While individual phosphonates may be used in combination with polymer(s) much better results have been obtained by using a blend of phosphonates such as A and B. When they are combined it is in a weight ratio of A:B of from 0.5/1–4/1 and preferably from 0.5/1–2/1 and most preferably about 0.67/1.

In addition to phosphonates, additives such as tolytriazole may be utilized. Tolytriazole is effective in the reduction of copper substrate corrosion.

The Water-Soluble Noncrossed Linked Random Copolymers

These polymers are described in detail in U.S. Pat. No. 4,566,973, specifically they are described by the patentee as follows:

The copolymers suitable herein are random polymers containing polymerized units of an acrylic acid and substituted acrylamide, represented by the following structural formula I:

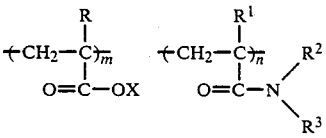

where m and n are numbers in the range of about 0.1 to 700, with m being in the range of about 10 to 700 and n is in the range of about 0.1 to 350, subject to molecular weight limitations; R and $R^1$ are individually selected from hydrogen and methyl; X is hydrogen, alkali metal, alkaline earth metal, or ammonium, particularly hydrogen, sodium, potassium, calcium, ammonium, and magnesium; and $R^2$ and $R^3$ are individually selected from hydrogen, alkyl and substituted alkyl groups each containing a total of 1 to 8 carbon atoms, provided that both $R^2$ and $R^3$ are not hydrogen although either $R^2$ or $R^3$ can be hydrogen. Substituents on the $R^2$ and $R^3$ groups include alkyl, aryl, and keto groups, however, in a preferred embodiment, $R^2$ and $R^3$ are individually selected from alkyl groups of 1 to 8 carbon atoms and substituted alkyl groups of 1 to 8 carbon atoms containing a keto substituent group. Specific examples of $R^2$ and $R^3$ include t-butyl, isopropyl, isobutyl, methyl, 2-(2,4,4-trimethylpentyl) and 2-(2-methyl-4-oxopentyl).

Suitable acrylic acids for purposes herein are generally defined as monounsaturated monocarboxylic acids containing 3 to 4 carbon atoms. Specific examples of such acids include acrylic and methacrylic acids, with acrylic acid being preferred. Substituted acrylamides referred to herein are generally defined to include the class of acrylamides substituted on the nitrogen atom with alkyl groups each containing 1 to 8 carbon atoms.

Other comonomers can be used with an acrylic acid and a substituted acrylamide provided that such additional comonomers do not deleteriously affect the desired properties. Examples of such comonomers include acrylate and methacrylate esters, acrylamide and methacrylamide, acrylonitrile, vinyl esters, etc.

The acrylic acid units in the copolymer can be in the acid form or in a neutralized form where the hydrogen of the carboxyl group is replaced with an alkali metal, alkaline earth metal, or an ammonium cation, depending on the neutralizing medium. Generally, the copolymers can be neutralized with a strong alkali, such as sodium hydroxide, in which instance, the hydrogen or the carboxyl group of the acrylic acid units will be replaced with sodium. With the use of an amine neutralizing agent, the hydrogen will be replaced with an ammonium group Useful copolymers include copolymers that are unneutralized, partially neutralized, and completely neutralized.

Polymerization of the monomers results in an essentially non-crosslinked random copolymer, the molecular weight of which can be adjusted with a little trial and error. The copolymer is preferably formed in a high yield ranging from about 50% to about 99% by weight of the comonomers.

The polymers of the type described above may be modified by incorporating into their structure up to 30% by weight of a termonomer which contains: a non-ionic or anionic polar group from the group selected preferably consisting of amido, lower alkyl ester, and maleic acid salt groups.

Examples of preferred monomers that may be polymerized to form terpolymers are acrylamide, methyl, or ethyl acrylate, maleic anhydride. Other polar monomers that may be used are, for example, vinyl acetate, acrylonitrile, the various vinyl ketones, vinyl ethers and the like. Illustrative of these monomers are the compounds: vinyl pyrrolidone, methyl vinyl ether, methacrylonitrile, allyl alcohol, methyl methacrylate, beta-diethylaminoethyl methacrylate, vinyl trimethylacetate, methyl isobutyrate, cyclohexyl methacrylate, vinyl laurate, vinyl stearate, N-vinyl imides, N-vinyl lactams, diethylene glycol dimethacrylate, diallylmaleate, allyl methacrylate, diallyl phthalate, diallyl adipate, etc.

The polymers formed may have weight average molecular weight in the range of about 1,000 to about 50,000, and preferably about 2,000 to about 30,000, as determined by aqueous gel permeation chromatography using polystyrene of known molecular weight as a reference material.

The acid numbers of the copolymers formed, as determined by a conventional titration with KOH, may range from 310 to about 740, corresponding to a weight fraction of from 40% to about 95% by weight of monomer units having COOH groups. The preferred polymers have more than 50% by weight of free carboxyl groups and an acid number in the range from about 390 to about 700.

Preferred species are described in Table A below as Polymer Composition Nos. 1-12.

TABLE A

| Polymer Composition No. | M.W. | Composition (mol %) |
|---|---|---|
| | Polymer Materials | |
| 1 | (9300) | AA/t-BAm (88:12) |
| 2 | (12000) | " |
| 3 | (17700) | " |
| 4 | (25900) | " |
| 5 | (8900) | AA/EA/t-BAm (86:8:6) |
| 6 | (9400) | AA/Am/t-BAm (84:11:6) |
| 7 | (8200) | AA/MAA/t-BAm (68:19:13) |
| 8 | (13300)* | " |
| 9 | (14300)* | " |
| 10 | (15700)* | " |
| 11 | (15600) | " |
| 12 | (23000) | " |

Weight average molecular weight, i.e. M.W. or $M_w$.
*Aqueous $M_w$ estimated from GPC value using the THF eluent.

Polymer Composition Nos. 1-4 are unneutralized copolymers of acrylic acid and t-butylacrylamide (t-BAm). Polymer Composition No. 5, Polymer Composition 6, and Polymer Composition Nos. 7-12 are terpolymers which respectively contain the additional mer units of ethyl acrylate (EA), acrylamide (Am), and methacrylic acid (MAA).

A distinctive feature of all these polymers is the t-butylacrylamide unit. That sterically-hindered, hydrophobic alkylamide group exhibits excellent resistance to hydrolysis and the unit appears to confer exceptional performance characteristics upon polymers.

The copolymers composed of acrylic acid and t-butyl acrylamide contains between 50 to 90% by weight of acrylic acid and from 10-50% by weight of t-butyl acrylamide. Preferably the acrylic acid is present in a weight percent amount ranging between 70-90 with the t-butyl acrylamide being present at between 10-30. Most preferably the acrylic acid is present in a weight percent amount ranging between 80-90 with the t-butyl acrylamide being present at between 10-20.

The terpolymers are within the following weight percent composition ranges:

(a) acrylic acid 40-90 more preferably 40-80 and most preferably 60-80
(b) methacrylic acid 5-30 more preferably 10-30 and most preferably 10-20
(c) t-butyl acrylamide 5-50 more preferably 10-30 and most preferably 10-20

Dosage

The aqueous system is dosed based on active ingredients to provide thereto on a weight basis from between 5-50 ppm, preferably 8 to 40 ppm and most preferably 15-30 ppm of Compositions I and II previously described.

When the compositions are first added it is beneficial if they are dosed on the high side to control the corrosion and to begin forming protective films. After a week or so the dosages can be diminished until an optimum maintenance dosage is established.

Systems Treated and pH

The systems treated are industrial recirculating and once through cooling waters that either due to their natural make-up or by pH adjustment have a pH of at least 8. Preferably the pH of the systems are within the range of 8-9.5 and are most often within the range of 8.5-9.2. These systems are characterized as containing at least 10 ppm of calcium ion and are considered to be corrosive to ferrous metals as well as non-ferrous with which they come in contact.

DESCRIPTION OF THE PREFERRED EMBODIMENT

The following example is a repesentative formulation used in this program.

EXAMPLE 1

To a glass or stainless steel container is added 14 grams of softened water. With stirring, aqueous solutions of the following materials were added consecutively:

7 grams of 1-hydroxyethane-1,1-diphosphonic acid (60 wt%)

12 grams of 2-phosphonobutane-1,2,4-tricarboxylic acid (50 wt %)

15.3 grams of acrylic acid/t-butylacrylamide copolymer (49 wt%).

The mixture was cooled in an ice-bath and then basified by slow addition of approximately 22 grams of aqueous sodium hydroxide (50 wt%) to the vigorously stirred solution. During the addition of base, the solution's temperature was maintained below 130° F. The pH was adjusted to 13 with 4.7 grams of a 50 weight percent of a sodium tolyltriazole solution. Finally, sufficient softened water to produce 100 grams of product were added. The cooling bath was removed and the solution stirred until ambient temperature was reached.

Changes in the formulation are easily accommodated by simple modification of the previously listed procedure. For example, decreasing the amount of polymer and sodium hydroxide, followed by increasing the final amount of water added, will produce a formulation containing lower polymer actives. Alternatively, the polymer and corrosion inhibitors may be fed separately.

EXPERIMENTAL PROCEDURES

In laboratory tests, hardness cations and M alkalinity are expressed as $CaCO_3$ or cycles of concentration. $Fe^{+n}$ is listed as Fe, and inhibitors (monomeric and polymeric) are listed as actives. In analyses of heat-exchanger deposits, all components are listed as wt% of the chemical element or acid-form of the compound.

Calcium Phosphonate Inhibition

A standard heated "beaker" test was employed for evaluating performance of phosphonate inhibitors (Table B). Calcium and inhibitor stock solutions from the calcium phosphate inhibition test were used. In addition, stock solutions (1000 ppm actives) of Bayer PBS-AM and Dequest 2010 were prepared. Dequest-2010, made by the Monsanto Company, St. Louis, Mo. is described as hydroxy ethylidene 1,1-diphosphonic acid (HEDP) (CF. U.S. Pat. No. 3,959,168). PBS-AM is a trademark of Bayer for 2-phosphonobutane-1,2,4-tricarboxylic acid. To begin the test, distilled water, (400 mL) was added to the jacketed-beakers maintained at 60±2° C. The stock solutions were added to attain 360 ppm $Ca^{+2}$, 10 ppm inhibitor, 5.6 ppm Dequest and 8 ppm PBS-AM in the final 500 mL test volume. Next, the pH was adjusted to 9.2 using aqueous sodium hydroxide.

The pH of the test samples was manually adjusted at 15 minute intervals during the first hour and at 1 hour intervals, subsequently. A four hour test duration was sufficient for these precipitation reactions to stabilize. Finally, a portion of each test solution was passed through cellulose acetate/nitrate Millipore filter (type HA, 0.45 um). Both filtered and unfiltered aliquots were spectrophotometrically analyzed for total phosphate content. To study particle size effects, an additional sample was passed through a 0.10 um Millipore filter (type VC). The % inhibition was determined by a following formula:

$$\% \text{ inhibition} = \frac{[\text{filtered} - \text{blank}]}{[\text{unfiltered} - \text{blank}]} \times 100$$

TABLE B

Calcium Phosphonate Inhibition
10 ppm polymer actives
5.6 ppm Dequest 2010 & 8 ppm Bayer PBS-AM (as actives)
360 ppm Ca (as $CaCO_3$)
140° F./pH 9.2/4 hrs.

| Polymer Comp. No. | (M.W. $H_2O$) | % Inhibition filter size (um) 0.45 | 0.10 |
|---|---|---|---|
| 1 | (9300) | 82% | 26 |
| 5 | (8900) | 74 | 24 |
| 6 | (9400) | 8 | 13 |
| 11 | (15600) | 98 | 58 |
| Versa TL-4 | (19000) | 95 | 26 |

In calcium phosphonate inhibition tests, polymer performance versus precipitated particle size was examined and the results are presented in Table B.

The calcium phosphonate "inhibition" process involves minimizing particle growth. Maintaining scale particles at an extremely small size and mass may ultimately prove to be a pivotal factor in determining polymer performance. By using filters with mean pore sizes of 0.10 and 0.45 um, differences in polymer performance were readily observed. Polymer Composition No. 11 (MW=15,600) produced the best overall performance, and was the only polymer which exhibited good inhibition when a 0.10 um filter was used. Versa TL-4 (the low molecular weight copolymer of sulfonated styrene and maleic acid) and Polymer Composition Nos. 1 and 5 exhibited very good inhibition (0.45 um filter), but performance decreased rapidly when the filter pore size was reduced to 0.10 um. In particular, Polymer Composition No. 11 exhibited the best overall performance in both bench-top and PCT tests.

Performance in Products—PCT Tests pilot cooling tower test procedure

The pilot cooling tower test is a dynamic test which simulates many features present in an industrial recirculating cooling water system. The general test method is described in the article "Small-Scale Short-Term Methods of Evaluating Cooling Water Treatments . . . Are They Worthwhile?", by D. T. Reed and R. Nass, Minutes of the 36th Annual Meeting of the INTERNATIONAL WATER CONFERENCE, Pittsburgh, Pa., Nov. 4–6, 1975.

The general operating conditions are provided in Table C.

TABLE C

Pilot Cooling Tower Operating Conditions

| Tube # | Metal*/Heat Load (Btu/ft$^2$-hr) |
|---|---|
| 8 | MS/15,000 (top) |
| 7 | SS/15,000 |
| 6 | MS/12,400 |
| 5 | Adm/5,000 |
| 4 | MS/ 5,000 |

TABLE C-continued

| Pilot Cooling Tower Operating Conditions | |
|---|---|
| 3 | SS/12,400 |
| 2 | Adm/12,400 |
| 1 | SS/12,400 (bottom) |
| Make-up water: | Synthetic #3** |
| Desired Cycles: | 4 |
| Basin Volume/Temp.*** | 50L/125° F. |
| Holding Time Index | 24 hr. |
| Flow Rate | 2 gpm |
| pH | 9.2 |
| Product - high level | 200 ppm |
| Product - maintenance | 100 ppm |
| Test Duration | 14 days |

*MS = Mild Steel
Adm = Admiralty brass
SS = 306 Stainless steel
**Synthetic #3 contains total ion content of 90 ppm $Ca+^2$, 50 ppm $Mg+^2$, 90 ppm $Cl^-$, 50 ppm sulfate, 110 ppm Na+, and 110–120 ppm "M" alkalinity (as $CaCO_3$).
***Return water is 10° F. higher Polymer Composition Nos. 1, 3, 5, 6, 7 and 11, as described in Table D, were prepared pursuant to Example 1 and were used to directly replace VTL-4 in the high pH, standard formulation. Long-term stability testing (120° F./pH 13) of those formulations made pursuant to the procedure of Example 1 but containing polymer Composition Nos. 1, 6, or 11 revealed no hydrolysis of the polymer occurred over a 3 month period. PCT deposit/corrosion rates are summarized in Table D below:

TABLE D

| Polymer (ppm actives) | Heat Exchange Tube Results: Deposit (mg/day) MS | Adm | SS | Corrosion (mpy) MS | Adm | SS |
|---|---|---|---|---|---|---|
| Blank - No polymer* | 148 | 8 | — | 8.8 | 0.6 | — |
| Polymer Composition No. 1 (7.5) | 72 | 10 | 42 | 2.8 | 0.45 | 0.0 |
| Polymer Composition No. 3 (7.5) | 30 | 2 | 37 | 1.3 | 0.0 | −0.1 |
| Polymer Composition No. 5 (7.5) | 76 | 15 | 49 | 2.9 | 0.35 | 0.0 |
| Polymer Composition No. 6 (7.5) | 101 | 26 | 72 | 3.1 | 0.20 | 0.1 |
| Polymer Composition No. 7 (7.5) | 57 | 10 | 94 | 1.3 | 0.05 | 0.0 |
| Polymer Composition No. 11 (7.5) | 21 | 3 | 15 | 1.3 | 0.25 | 0.1 |
| Polymer Composition No. 11 (5)** | 50 | 1 | 22 | 2.9 | 0.04 | 0.0 |
| Versa TL-4 (7.5) | 54 | 7 | 27 | 2.8 | 0.2 | 0.0 |

*Blank was run at return temperature of 110° F. This reduction in severity of test conditions for the blank was necessitated by excessive scaling at higher temperatures.
**Average of two tests.

It has been found advisable in some cases to add small quantities of tolytriazole.

Tolytriazole is explained in Hackh's Chemical Dictionary, Fourth Edition, page 91 (CF. benzotriazole) and is employed as a corrosion inhibitor for copper and copper alloy surfaces in contact with water when it is used it is applied to the system at a dosage ranging between 1–20 ppm by weight.

Therefore, we claim:

1. A composition for inhibiting corrosion in industrial cooling waters which contain hardness and have a pH of at least 8 which composition comprises:

I. a phosphonate blend of 2-phosphonobutane-1,2,4-tricarboxylic acid and 1-hydroxyethylidene-1,1-diphosphonic acid, and II. a water-soluble non-crosslinked random terpolymer of 40 to 90 weight parts of an acrylic acid, 5 to 30 weight parts of methacrylic acid, and 5 to 50 weight parts of a t-butylacrylamide, based on a total of 100 weight parts of polymer, said polymer having a weight average molecular weight in the range of about 1,000 to 50,000, and the polymerized units of an acrylic acid and a t-butyl acrylamides are defined by the following formula:

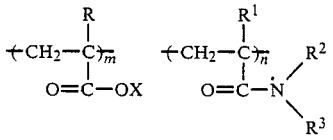

where m is in the range of about 10–700 and n is in the range of about 0.1 to 350, subject to the molecular weight limitations, R and $R^1$ are individually selected from hydrogen and methyl;

X is selected from hydrogen, sodium, potassium, calcium, ammonium, and magnesium moieties;

and $R^2$ and $R^3$ are individually selected from hydrogen, and substituted and unsubstituted groups each containing a total of 1 to 8 carbon atoms, wherein the substituents on $R^2$ and/or $R^3$ are selected from alkyl, aryl, and keto groups, provided that either $R^2$ and/or $R^3$ is t-butyl, with the weight ratio of polymer:phosphonate blend being within the range of 0.2/1 to 2.1.

2. The composition of claim 1 further including a corrosion inhibiting amount of tolytriazole.

3. The composition of claim 1, wherein the terpolymer has a weight average molecular weight of 9,000 to 30,000.

* * * * *